US007876272B2

(12) United States Patent
Dou et al.

(10) Patent No.: US 7,876,272 B2
(45) Date of Patent: Jan. 25, 2011

(54) ANTENNA DESIGN FOR AN ATTACHED ACCESSORY

(75) Inventors: Weiping Dou, San Jose, CA (US); Avi Kopelman, Sunnyvale, CA (US); Yomi Matsuoka, Cupertino, CA (US); Mark Babella, Salida, CA (US)

(73) Assignee: Palm, Inc., Sunnyvale, CA (US)

( * ) Notice: Subject to any disclaimer, the term of this patent is extended or adjusted under 35 U.S.C. 154(b) by 752 days.

(21) Appl. No.: 11/831,280

(22) Filed: Jul. 31, 2007

(65) Prior Publication Data

US 2010/0026589 A1 Feb. 4, 2010

(51) Int. Cl.
*H01Q 1/24* (2006.01)

(52) U.S. Cl. ..... 343/702; 343/906

(58) Field of Classification Search ..... 343/702, 343/700 MS, 906
See application file for complete search history.

(56) References Cited

U.S. PATENT DOCUMENTS 6,208,300 B1 * 3/2001 Johnson ..... 343/702
7,208,916 B1 4/2007 Boatwright et al.
7,623,078 B2 * 11/2009 Wang ..... 343/702
7,642,966 B2 * 1/2010 Vance ..... 343/700 MS
2007/0120752 A1 * 5/2007 Takasu ..... 343/702
2008/0143610 A1 * 6/2008 Wang et al. ..... 343/702
2008/0252536 A1 * 10/2008 Anguera et al. ..... 343/702

* cited by examiner

*Primary Examiner*—HoangAnh T Le
(74) *Attorney, Agent, or Firm*—Kacvinsky Daisak PLLC

(57) ABSTRACT

Various embodiments are directed to antenna designs that may improve the performance of a mobile computing device. Some embodiments are directed to a mobile computing device assembly comprising accessory incorporating a supplemental antenna designed to be adjacent to at least one internal antenna of a mobile computing device when the accessory is attached to the mobile computing device. The supplemental antenna and the internal antenna may cooperatively form an antenna system for the mobile computing device resulting in improved performance. In various implementations, the use of the supplemental antenna in conjunction with the internal antenna may enhance antenna performance and/or increase antenna efficiency. Other embodiments are described and claimed.

21 Claims, 3 Drawing Sheets

ANTENNA DESIGN FOR AN ATTACHED ACCESSORY

BACKGROUND

Antenna design for a mobile computing device is an important consideration and is often limited by strict performance constraints. For a mobile computing device with a small form factor, an internal antenna may be located very close to a removable battery. In some cases, there is not enough distance between the battery and the antenna to isolate mutual coupling. Such coupling could introduce an additional inductor and/or capacitor resulting in reduced antenna performance.

To ensure desired performance of a mobile computing device, the design of each antenna may be optimized for use with a standard battery. If the antenna design is optimized for a standard battery, however, performance may be degraded when the mobile computing device is attached to an accessory such as an extended battery used instead of the standard battery. Accordingly, there exists the need for improved antenna designs for achieving desired performance when using an attached accessory.

DETAILED DESCRIPTION

Various embodiments are directed to antenna designs that may improve the performance of a mobile computing. For example, some embodiments are directed to a mobile computing device assembly comprising an accessory incorporating a supplemental antenna designed to be adjacent to at least one internal antenna of a mobile computing device when the accessory is attached to the mobile computing device. The supplemental antenna and the internal antenna may cooperatively form an antenna system for the mobile computing device resulting in improved performance. In various implementations, the use of the supplemental antenna in conjunction with the internal antenna may enhance antenna performance and/or increase antenna efficiency. Accordingly, a user may realize enhanced products and services.

Figure 1:
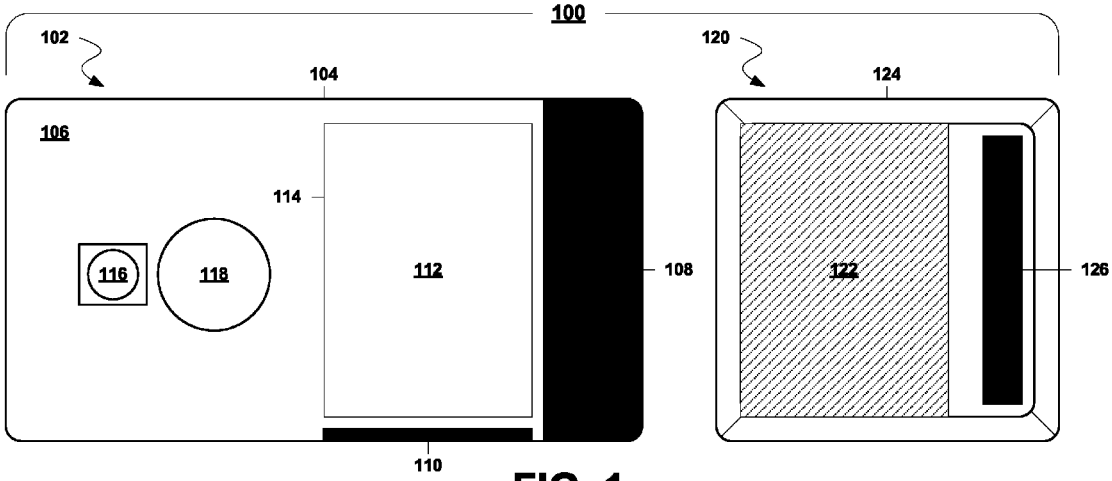
FIGS. 1-5 illustrate a mobile computing device assembly comprising an extended battery accessory in accordance with various embodiments.

FIG. 1 illustrates one embodiment of a mobile computing device assembly 100 comprising a mobile computing device 102. Mobile computing device 102 may comprise or be implemented as a combination handheld computer and mobile telephone or smart phone such as a Palm® Treo™ smart phone. Although some embodiments may be described with mobile computing device 102 implemented as a smart phone by way of example, it may be appreciated that mobile computing device 102 may be implemented as any type of wireless device, mobile station, or portable computing device with a self-contained power source (e.g., battery) such as a laptop computer, handheld device, personal digital assistant (PDA), mobile telephone, combination mobile telephone/PDA, mobile unit, subscriber station, user terminal, wearable computing device, game device, messaging device, media player, pager, data communication device, or any other suitable computing or processing system in accordance with the described embodiments.

Mobile computing device 102 may comprise a housing 104 used to encapsulate various components for mobile computing device 102 such as a printed circuit board (PCB) 106, internal antennas 108, 110, a removable and rechargeable battery 112 within a battery compartment 114, a camera 116, a speaker 118, as well as one or more processors (e.g., host processor, radio processor, modem processor, baseband processor), memory (e.g., volatile or non-volatile memory, removable or non-removable memory, erasable or non-erasable memory, writeable or re-writeable memory), transceivers (e.g., voice communications transceiver, data communications transceiver, GPS transceiver), and others.

Housing 104 may include one or more materials such as plastic, metal, ceramic, glass, carbon fiber, various polymers, and so forth, suitable for enclosing and protecting the internal components of mobile computing device 102. In various embodiments, housing 104 may have a shape, size and/or form factor capable of being held with an average human hand. In one exemplary embodiment, the size of housing 104 may be approximately 115 mm (Length)×60 mm (Width)×24 mm (Thickness).

PCB 106 may be implemented using materials such as FR4, Rogers R04003, and/or Roger RT/Duroid, for example, and may include one or more conductive traces, via structures, and/or laminates. PCB 106 also may include a finish such as Gold, Nickel, Tin, or Lead. In various implementations, PCB 106 may be fabricated using processes such as etching, bonding, drilling, and plating.

Mobile computing device 102 may have an internal antenna architecture comprising a first internal antenna 108 and a second internal antenna 110 disposed on the PCB 106. Although only first internal antenna 108 and second internal antenna 110 are shown for purposes of illustration, it can be appreciated that mobile computing device 102 may comprise other internal antennas and/or external antennas (e.g., stub antenna, whip antenna, extendable antenna) in accordance with the described embodiments. It also can be appreciated that while an exemplary embodiment of an internal antenna design is illustrated, the precise placement or location of first internal antenna 108 and second internal antenna 110 on PCB 106 may be determined in accordance with various performance and design constraints.

In various embodiments, first internal antenna 108 and/or second internal antenna 110 each may comprise a single antenna or may be part of an array of antennas, such as a quad band antenna array. For example, multiple antennas in the form an antenna array may be employed when implementing spatial diversity techniques (e.g., beamforming) and/or high-throughput Multiple-Input-Multiple-Output (MIMO) systems (e.g., 802.11n and 802.16e systems).

First internal antenna 108 and/or second internal antenna 110 may be implemented using any suitable type of internal antenna in accordance with the described embodiments. Examples of internal antennas include, without limitation, a planar inverted-F antenna, a paper-clip antenna, a planar inverted-L antenna, a monopole antenna, a meandered monopole antenna, a dipole antenna, a balanced antenna, a printed helical antenna, a chip antenna, a ceramic antenna, and others.

In some embodiments, first internal antenna 108 and/or second internal antenna 110 may comprise a flexible material or substrate. A flexible material may include any pliant material that is capable of being bent or flexed such as a flexible printed circuit (FPC). Other flexible materials may be used, however, such as a wire material, helical material, Teflon material, RF4 material, Mylar material, dielectric substrate, a soft plastic material, and other flexible materials.

In some embodiments, first internal antenna 108 and/or second internal antenna 110 may comprise a rigid material rather than a flexible material. A rigid material may include any material that is deficient in or devoid of flexibility. Examples of rigid materials may include metal materials, plastic materials, ceramic materials, and so forth. In one embodiment, for example, first internal antenna 108 and/or second internal antenna 110 may be formed using a flat stamped metal having suitable design and performance characteristics for mobile computing device 102.

First internal antenna 108 and second internal antenna 110 may remain in a fixed position internal to housing 104 in order to reduce the size and form factor of mobile computing device 102. First internal antenna 108 and/or second internal antenna 110 may be etched into PCB 106, mounted to PCB 106, or integrated with the midframe or housing 104 of mobile computing device 102. In some cases, first internal antenna 108 and/or second internal antenna 110 may comprise multiple layers and/or multiple traces. The number of layers and length of each layer may vary for a particular implementation. The antenna traces may have any suitable pattern or geometry tuned for various operating frequencies. First internal antenna 108 and second internal antenna 110 may be implemented by antenna traces and/or branch lines and may comprise various chip components (e.g., resistors, capacitors, inductors) and/or circuitry (e.g., balun element, hybrid phase element).

First internal antenna 108 and second internal antenna 110 each may be arranged to transmit and/or receive electrical energy in accordance with a given set of performance or design constraints as desired for a particular implementation. For example, first internal antenna 108 and second internal antenna 110 may be configured for both transmission and reception. During transmission, an antenna (e.g., first internal antenna 108 and/or second internal antenna 110) may accept energy from a transmission line and radiate energy into space via a wireless shared media. During reception, an antenna may gather energy from an incident wave received over the wireless shared media, and provide energy to a corresponding transmission line. In various embodiments, first internal antenna 108 and second internal antenna 110 may operate at the same time for transmitting, receiving, or both.

First internal antenna 108 and second internal antenna 110 each may be arranged to allow voice communication and/or data communication. For example, mobile computing device 102 may provide voice communications functionality in accordance with one or more cellular telephone systems. Examples of cellular telephone systems may include Code Division Multiple Access CDMA systems, Global System for Mobile Communications (GSM) systems, North American Digital Cellular (NADC) systems, Time Division Multiple Access (TDMA) systems, Extended-TDMA (E-TDMA) systems, Narrowband Advanced Mobile Phone Service (NAMPS) systems, third generation (3G) systems such as Wide-band CDMA (WCDMA), CDMA-2000, Universal Mobile Telephone System (UMTS) systems, and others.

In addition to voice communications functionality, mobile computing device 102 may provide wireless wide area network (WWAN) data communications functionality in accordance with one or more cellular telephone systems. Examples of cellular telephone systems offering WWAN data communications services may include Evolution-Data Optimized or Evolution-Data only (EV-DO) systems, Evolution For Data and Voice (EV-DV) systems, CDMA/1xRTT systems, GSM with General Packet Radio Service systems (GSM/GPRS), Enhanced Data Rates for Global Evolution (EDGE) systems, High Speed Downlink Packet Access (HSDPA) systems, High Speed Uplink Packet Access (HSUPA), and others.

Mobile computing device 102 may be arranged to provide data communications functionality in accordance with various types of wireless local area network (WLAN) systems. Examples of suitable WLAN systems offering data communications services may include the Institute of Electrical and Electronics Engineers (IEEE) 802.xx series of protocols, such as the IEEE 802.11a/b/g/n series of standard protocols and variants (also referred to as "WiFi"), the IEEE 802.16 series of standard protocols and variants (also referred to as "WiMAX"), the IEEE 802.20 series of standard protocols and variants, and others.

Mobile computing device 102 may be arranged to perform data communications functionality in accordance with various types of shorter range wireless systems, such as a wireless personal area network (PAN) system. An exemplary wireless PAN system offering data communications services is a Bluetooth system operating according to the Bluetooth Special Interest Group (SIG) series of protocols, including Bluetooth Specification versions v1.0, v1.1, v1.2, v2.0, v2.0 with Enhanced Data Rate (EDR), as well as one or more Bluetooth Profiles, and so forth. Other examples may include systems using infrared (IR) techniques or near-field communication techniques and protocols, such as electro-magnetic induction (EMI) techniques. Exemplary EMI techniques may include passive or active radio-frequency identification (RFID) protocols and devices.

First internal antenna 108 and the second internal antenna 110 may be tuned for operating at one or more frequency bands. This may be desirable since mobile computing device 102 may be compatible with multiple wireless data, multimedia and cellular telephone systems. In addition, mobile computing device 102 may implement various spatial diversity techniques to improve communication of wireless signals across one or more frequency bands of wireless shared media such as EV-DO diversity at both the 850 MHz cellular band and the 1900 MHz PCS band.

In some cases, mobile computing device 102 may be implemented as a multi-band wireless device supporting operation in multiple frequency bands. For example, mobile computing device 102 may be arranged to operate in various frequency bands or sub-bands such as the 2.4 GHz range of the ISM frequency band for WiFi and Bluetooth communications, one or more of the 850 MHz, 900 MHZ, 1800 MHz, and 1900 MHz frequency bands for GSM, CDMA, TDMA, NAMPS, cellular, and/or PCS communications, the 2100 MHz frequency band for CDMA2000/EV-DO and/or WCDMA/UMTS communications, the 1575 MHz frequency band for Global Positioning System (GPS) operations, and other frequency bands.

In one exemplary embodiment, first antenna 108 may be arranged to allow voice communication and second internal antenna 110 may be arranged to allow data communication. For example, first internal antenna 108 may allow voice communication such as tri-band GSM operation in the 850 MHz frequency band, the 1800 MHz frequency band, and the 1900 MHz frequency band (850/1800/1900 MHz). Second internal antenna 110 may allow data communication such as Bluetooth operation using the 2.4 GHz range of the ISM frequency band. It can be appreciated that other types voice communications, data communications, and/or frequency bands may be used in accordance with the described embodiments.

Mobile computing device 102 may comprise a low-profile, small and compact device design. Accordingly, the structure and arrangement of first internal antenna 108 and second internal antenna 110 may be designed or optimized taking into account the limited availability of space given the location of various components of mobile computing device 102 such as removable battery 112 within battery compartment 114. Battery 112 may comprise a standard battery provided with mobile computing device 102, such as a removable and rechargeable lithium ion battery.

As shown, first internal antenna 108 and second internal antenna 110 may positioned in close proximity to battery 112 of mobile computing device 102. In some cases, the design and placement of first internal antenna 108 and second internal antenna 110 may be optimized for use with battery 116 to minimize or isolate mutual coupling. Such isolation may be important for applications and/or systems which have strict interference requirements as well as for devices with smaller platforms.

In various embodiments, mobile computing device assembly 100 may comprise an accessory to attach to mobile computing device 102. In one exemplary embodiment, the accessory may comprise or be implemented as an extended battery accessory 120 including an extended battery 122 and an extended battery cover 124. Extended battery 122 may be used instead of standard battery 112 in order to increase battery life. In general, extended battery 122 may be structured and arranged to fit in battery compartment 114 but is thicker or larger than standard battery 112 to allow more power capacity. It can be appreciated that if the design of the internal antenna architecture has been optimized for standard battery 112, antenna performance may be degraded when extended battery 122 is used instead.

Typically, there are two kinds of degradation that may be caused when using extended battery 122. First, extended battery 122 may introduce an additional inductor and/or capacitor, which may shift one or more resonant frequencies of an antenna (e.g., first internal antenna 108). Second, extended battery 122 may absorb or block radiating energy so that even through the resonance is not shifted, the efficiency of the antenna (e.g., second internal antenna 110) is reduced.

For example, mobile computing device 102 may comprise first internal antenna 108 implemented as a tri-band GSM 850/1800/1900 MHz antenna and second internal antenna 110 implemented as a Bluetooth antenna working at 2.45 GHz. As shown, both of first internal antenna 108 and second internal antenna 110 are located close to battery compartment 114. When using standard battery 112, the GSM 850/1800/1900 MHz antenna (e.g., first internal antenna 108) may have two resonances at 869 MHz and 1880 MHz. When standard battery 112 is replaced by extended battery 122, however, the resonances may shift up to 894 MHz and 1990 MHz, respectively. While the Bluetooth antenna (e.g., second internal antenna 110) may have the same resonant frequency at 2.45 GHz, the efficiency may be 45% when using standard battery 112 and only 34% when using extended battery 122.

In various embodiments, an accessory such as extended battery accessory 120 may comprise a supplemental antenna 126. Supplemental antenna 126 may comprise or be implemented as one or more metal pieces. Exemplary metallic materials (e.g., metals and/or alloys) that may be used for supplemental antenna 126 may include stainless steel, phosphor bronze, flex copper, or any other suitable material in accordance with the describe embodiments.

In some embodiments, supplemental antenna 126 may be installed or incorporated in an inner part of the accessory. As shown in FIG. 1, for example, supplemental antenna 126 may be included in an inner part of battery cover 124. In other embodiments, supplemental antenna 126 may be installed or incorporated in an outer part of the accessory. In some cases, supplemental antenna 126 may include or be shaped as a logo, accent and/or other cosmetic shape to improve the overall aesthetics of mobile computing device 102. It can be appreciated that the precise size, shape, and location of supplemental antenna 126 may be determined in accordance with various performance and design constraints.

Figure 2:
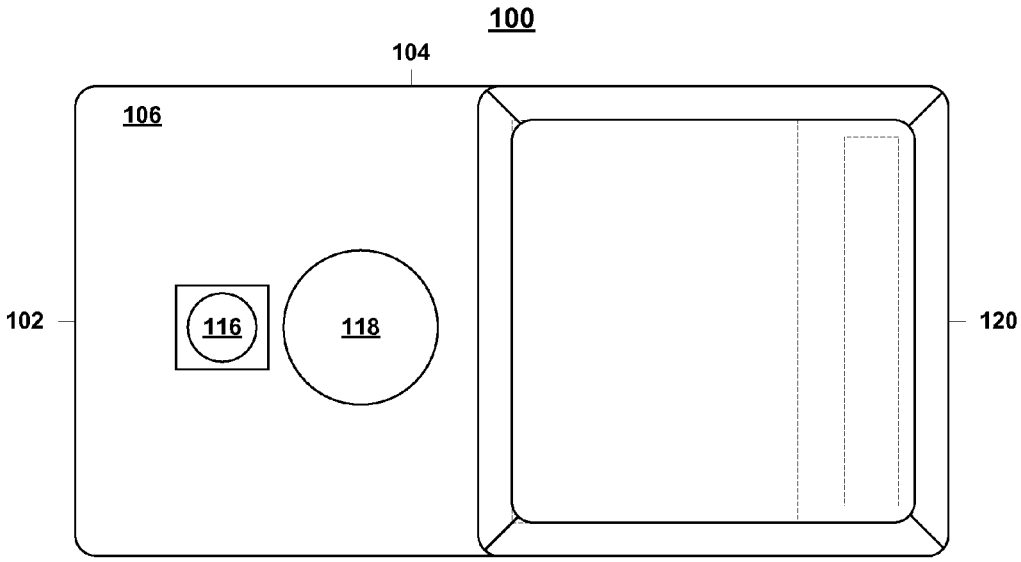

Mobile computing device assembly 100 may comprise an accessory (e.g., extended battery accessory 120) attached to mobile computing device 102. As shown in FIG. 2, for example, extended battery accessory 120 may be attached to mobile computing device 102. In this exemplary embodiment, extended battery 122 has replaced standard battery 112, and extended battery cover 124 is designed to attach to housing 104 of mobile computing device 102.

Figure 3:
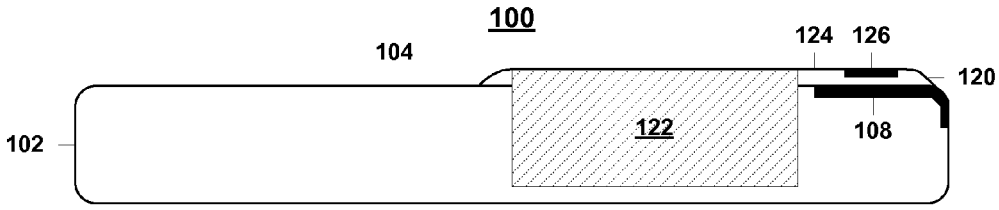
Figure 4:
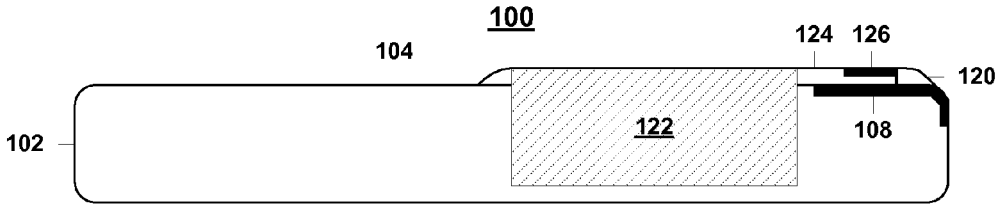

In some embodiments, supplemental antenna 126 may be designed to be adjacent to at least one internal antenna of mobile computing device 102 when the accessory is attached. As shown in FIG. 3, for example, when extended battery accessory 120 is attached to mobile computing device 102, supplemental antenna 126 is adjacent to first internal antenna 108 of mobile computing device 102. In other embodiments, supplemental antenna 126 may be designed to contact at least one internal antenna of mobile computing device 102 when the accessory is attached. As shown in FIG. 4, for example, when extended battery accessory 120 is attached to mobile computing device 102, supplemental antenna 126 directly contacts first internal antenna 108 of mobile computing device 102.

Because extended battery 122 is thicker and/or broader than standard battery 112, extended battery cover 124 is not seamless or flush with internal antenna 108. As a result, a chamber or aperture exists between extended battery cover 124 and internal antenna 108. In an exemplary embodiment, supplemental antenna 126 may be incorporated inside of extended battery cover 124 which is spaced apart from internal antenna 126 by a distance of 1.2 mm. The room or space between internal antenna 108 and extended battery cover 124 may be utilized in various ways to increase antenna performance. For example, the additional space introduced by extended battery cover 124 may be used as additional antenna volume to improve overall antenna performance. By carefully arranging one or more metal pieces of supplemental antenna 126 in a desired shape and location, the antenna performance of mobile computing device 102 may be optimized for use with extended battery 122.

When adjacent to or directly contacting each other, first internal antenna 108 and supplemental antenna 126 may cooperatively form an antenna system to improve performance of mobile computing device 102. For example, supplemental antenna 126 may serve as a new antenna or part of new antenna. Supplemental antenna 126 may comprise one or several metallic pieces incorporated or attached within extend battery cover 124 and may be adjacent to or in direct contact with first internal antenna 108.

In various implementations, antenna performance of mobile computing device 102 may be improved by reducing or retuning one or more resonances of first internal antenna 108. In an exemplary embodiment, first internal antenna 108 may be implemented by a GSM 850/1800/1900 MHz antenna. In this embodiment, one or more resonances of first internal antenna 108 may be shifted higher (e.g., from 869 MHz and 1880 MHz to 894 MHz and 1990 MHz) when standard battery 112 is replaced by extended battery 122.

When supplemental antenna 126 is in close proximity to first internal antenna 108 as shown in FIG. 3, for example, supplemental antenna 126 may be arranged to introduce a parasitic capacitor to reduce one or more resonances of first internal antenna 108. Introduction of parasitic capacitance into the overall radiating system may compensate for or counteract the undesired shifting of resonances resulting from use of extended battery 122.

When supplemental antenna 126 is in direct contact with first internal antenna 108 as shown in FIG. 4, for example, supplemental antenna 126 may be arranged to extend the physical length of the radiating element to retune one or more of the antenna resonances at lower frequencies. Accordingly, supplemental antenna 126 may retune one or more resonances to compensate for or counteract undesired shifting resulting from use of extended battery 122.

Figure 5:
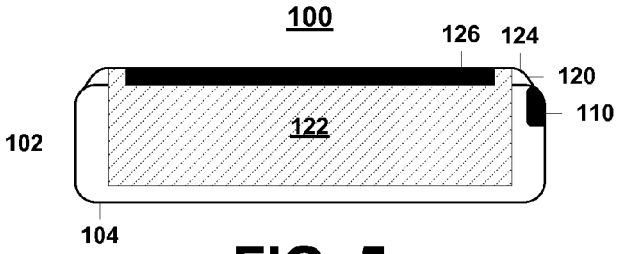

As shown in FIG. 5, room or space may exist between second internal antenna 110 and extended battery cover 124. Accordingly, such room or space may be utilized in various ways to increase antenna performance. When adjacent to or directly contacting each other, second internal antenna 110 and supplemental antenna 126 may cooperatively form an antenna system to improve performance of mobile computing device 102. For example, supplemental antenna 126 may serve as a new antenna or part of new antenna. Supplemental antenna 126 may comprise one or several metallic pieces incorporated or attached within extend battery cover 124 and may be adjacent to or in direct contact with second internal antenna 110.

In various implementations, antenna performance of mobile computing device 102 may be improved by increasing antenna efficiency of second internal antenna 110. In an exemplary embodiment, second internal antenna 110 may be implemented by a Bluetooth antenna. In this embodiment, the resonance of second internal antenna 110 is not shifted but the efficiency of second internal antenna 100 is significantly reduced (e.g., from 45% to 34%) when standard battery 112 is replaced by extended battery 122.

When supplemental antenna 126 is in close proximity to or in direct contact with second internal antenna 110, supplemental antenna 126 may be arranged to serve as a new antenna while second internal antenna 110 serves as feed. In some implementations, the supplemental antenna 126 may comprise a first antenna arm of a new antenna system and second internal antenna 110 may comprise a second antenna arm of the antenna system. The supplemental antenna 126 and second internal antenna 110 may cooperate to increase overall antenna efficiency of mobile computing device 102.

While some embodiments may comprise extended battery 122, it can be appreciated that the embodiments are not limited in this context. In particular, supplemental antenna 126 may be used for enhancing the antenna performance of mobile computing device 102 with standard battery 112.

Figure 6:
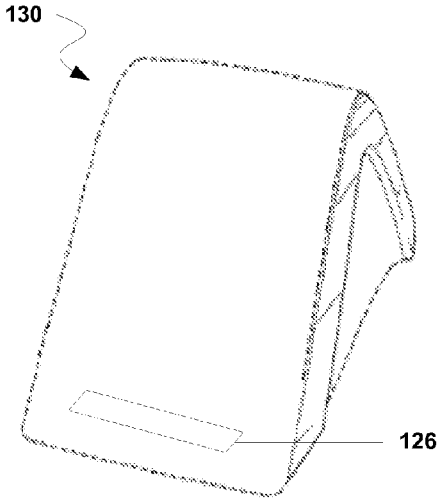
FIG. 6 illustrates a cradle accessory in accordance with various embodiments.

As shown in FIG. 6, for example, supplemental antenna 126 may be incorporated into a cradle accessory 130. Supplemental antenna 126 may be designed to be adjacent to at least one internal antenna of mobile computing device 102 when cradle accessory 130 is attached to mobile computing device 102. In various embodiments, mobile computing device 102 may comprise standard battery 112.

Figure 7:
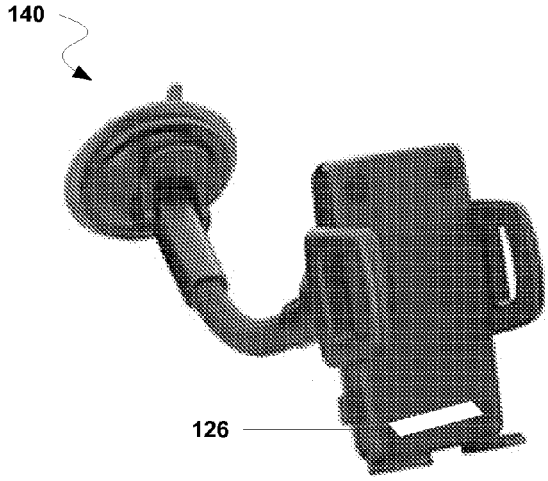
FIG. 7 illustrates a car kit accessory in accordance with various embodiments.

As shown in FIG. 7, for example, supplemental antenna 126 may be incorporated into a car kit accessory 140. Supplemental antenna 126 may be designed to be adjacent to at least one internal antenna of mobile computing device 102 when car kit accessory 140 is attached to mobile computing device 102. In various embodiments, mobile computing device 102 may comprise standard battery 112.

Figure 8:
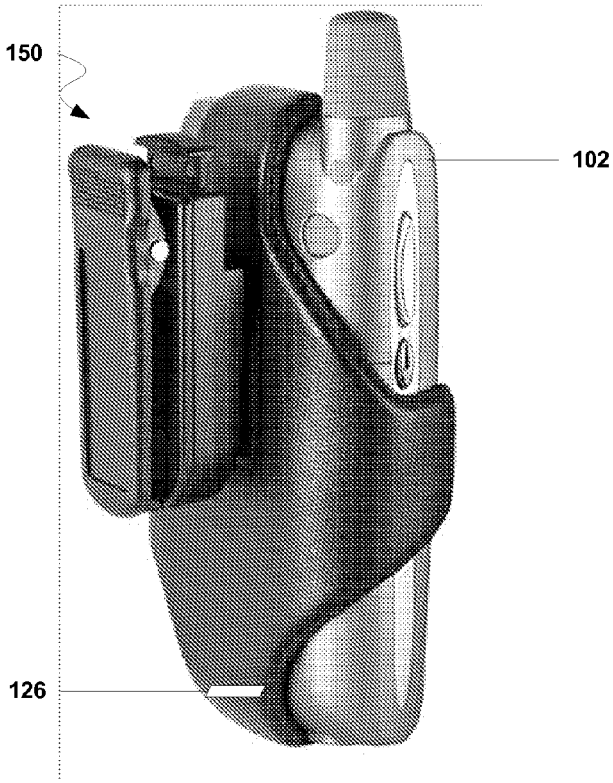
FIG. 8 illustrates a mobile computing device and a holster accessory in accordance with various embodiments.

As shown in FIG. 8, for example, supplemental antenna 126 may be incorporated into a holster accessory 150. Supplemental antenna 126 may be designed to be adjacent to at least one internal antenna of mobile computing device 102 when holster accessory 150 is attached to mobile computing device 102. In various embodiments, mobile computing device 102 may comprise standard battery 112.

In various implementations, supplemental antenna 126 may be designed as a parasitic radiator to an existing antenna (e.g., first internal antenna 108, second internal antenna 110) of mobile computing device 102 when standard battery 112 is used. The combination of the existing antenna and supplemental antenna 126 may function as an antenna array to significantly improve overall antenna efficiency. For example, if supplemental antenna 126 and the existing antenna both resonant at the same frequency, the antenna efficiency may be doubled. If supplemental antenna 126 and the existing antenna do not resonant at the same frequency, the combination becomes a direct array to broaden bandwidth and/or make the radiation pattern more directional.

Numerous specific details have been set forth above to provide a thorough understanding of the embodiments. It will be understood, however, that the embodiments may be practiced without these specific details. In other instances, well-known operations, components and circuits have not been described in detail so as not to obscure the embodiments. It can be appreciated that the specific structural and functional details are representative and do not necessarily limit the scope of the embodiments.

Various embodiments may comprise one or more elements. An element may comprise any structure arranged to perform certain operations. Each element may be implemented as hardware, software, or any combination thereof, as desired for a given set of design and/or performance constraints. Although an embodiment may be described with a limited number of by way of example, the embodiment may include more or less elements in alternate topologies as desired for a given implementation.

It is worthy to note that some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

Various embodiments may comprise one or more functional components or modules for performing various operations. It can be appreciated that such components or modules may be implemented by one or more hardware components, software components, and/or combination thereof. The functional components and/or modules may be implemented, for example, by logic (e.g., instructions, data, and/or code) to be executed by a logic device (e.g., processor). Such logic may be stored internally or externally to a logic device on one or more types of computer-readable storage media.

It is also worthy to note that any reference to "various embodiments," "one embodiment," or "an embodiment" means that a particular feature, structure, or characteristic described in connection with the embodiment is included in at least one embodiment. Thus, appearances of the phrases "in various embodiments," "in one embodiment," or "in an embodiment" in places throughout the specification are not necessarily all referring to the same embodiment. Furthermore, the particular features, structures or characteristics may be combined in any suitable manner in one or more embodiments.

While certain features of the embodiments have been illustrated as described above, many modifications, substitutions, changes and equivalents will now occur to those skilled in the art. It is therefore to be understood that the appended claims are intended to cover all such modifications and changes as fall within the true spirit of the embodiments.

The invention claimed is:

1. A mobile computing device assembly comprising:

a mobile computing device comprising a housing enclosing a printed circuit board including at least a first internal antenna;

an accessory attached to the housing of the mobile computing device, the accessory comprising a supplemental antenna adjacent to the internal antenna, the first internal antenna and the supplemental antenna cooperatively forming an antenna system for the mobile computing device; and wherein the supplemental antenna comprising at least one metal piece.

2. The mobile computing device assembly of claim 1, the first internal antenna to allow voice communication.

3. The mobile computing device assembly of claim 1, the first internal antenna to allow data communication.

4. The mobile computing device assembly of claim 1, the printed circuit board comprising at least a second internal antenna, the first antenna to allow voice communication and the second internal antenna to allow data communication.

5. The mobile computing device assembly of claim 1, the metal piece comprising at least one of stainless steel, phosphor bronze, and flex copper.

6. The mobile computing device assembly of claim 1, wherein the supplemental antenna and the internal antenna are in direct contact.

7. The mobile computing device assembly of claim 1, the supplemental antenna to introduce a parasitic capacitor to reduce one or more resonances of the first internal antenna.

8. The mobile computing device assembly of claim 1, the supplemental antenna to retune one or more resonances of the first internal antenna at a lower frequency.

9. The mobile computing device assembly of claim 1, the supplemental antenna to extend radiation of the first internal antenna.

10. The mobile computing device assembly of claim 9, the supplemental antenna comprising a parasitic radiator for the first internal antenna.

11. The mobile computing device assembly of claim 9, the supplemental antenna to extend physical radiation length of the first internal antenna.

12. The mobile computing device assembly of claim 1, the supplemental antenna to increase efficiency of the first internal antenna.

13. The mobile computing device assembly of claim 1, the first antenna to serve as a feed to the supplemental antenna.

14. The mobile computing device assembly of claim 1, the first internal antenna comprising a first antenna arm of the antenna system and the supplemental antenna comprising a second antenna arm of the antenna system.

15. The mobile computing device assembly of claim 1, wherein the first internal antenna and the supplemental antenna are resonant at the same frequency.

16. The mobile computing device assembly of claim 1, wherein the first internal antenna and the supplemental antenna are resonant at different frequencies.

17. The mobile computing device assembly of claim 1, the accessory comprising an extended battery cover.

18. The mobile computing device assembly of claim 1, the accessory comprising at least one of a cradle, a car kit, and a holster.

19. The mobile computing device assembly of claim 1 further comprising an extended battery.

20. An accessory to attach to a mobile computing device, the accessory comprising:

a supplemental antenna, the supplemental antenna being adjacent to at least one internal antenna of the mobile computing device when the accessory is attached to the mobile computing device, the supplemental antenna and the internal antenna forming an antenna system for the mobile computing device; and wherein the supplemental antenna and the internal antenna are in direct contact.

21. An antenna system for a mobile computing device comprising:

a first internal antenna disposed on a printed circuit board within a housing of a mobile computing device;

a supplemental antenna incorporated into an accessory to attach to the mobile computing device, the supplemental antenna being adjacent to the internal antenna when the accessory is attached to the mobile computing device; and wherein the supplemental antenna comprising at least one metal piece.

* * * * *